United States Patent [19]

Hektoen

[11] 4,236,731

[45] Dec. 2, 1980

[54] CONTINUOUS STATIONERY ASSEMBLY AND METHODS OF MAKING BINDERS, FOLDER COVERS AND THE LIKE FROM THE ASSEMBLY

[75] Inventor: Per Hektoen, Osteras, Norway

[73] Assignee: Moore Business Forms, Limited, London, England

[21] Appl. No.: 14,218

[22] Filed: Feb. 22, 1979

[30] Foreign Application Priority Data

Feb. 23, 1978 [GB] United Kingdom ..... 07264/78

[51] Int. Cl.[3] ..... B41L 1/20

[52] U.S. Cl. ..... 282/11.5 A; 282/11.5 R; 206/627; 229/69

[58] Field of Search ..... 282/11.5 R, 11.5 A; 93/73, 61 R; 206/627; 229/69

[56] References Cited

U.S. PATENT DOCUMENTS

| | | | |
|---|---|---|---|
| 3,820,447 | 6/1974 | Gendron et al. | 282/11.5 A X |
| 4,032,065 | 6/1977 | Heimann | 282/11.5 A X |
| 4,050,582 | 9/1977 | Kalve | 282/11.5 A X |
| 4,108,352 | 8/1978 | Peschke | 282/11.5 A X |

FOREIGN PATENT DOCUMENTS

| | | | |
|---|---|---|---|
| 1172283 | 6/1964 | Fed. Rep. of Germany | 282/11.5 A |
| 6708451 | 6/1967 | Netherlands | 282/11.5 A |

*Primary Examiner*—Paul A. Bell

*Attorney, Agent, or Firm*—Allegretti, Newitt, Witcoff & McAndrews

[57] ABSTRACT

Improved continuous stationery assemblies are disclosed which are capable of being readily converted into binders, folder covers, and the like, and which are adapted to have personalized matter printed or typed on the webs of the assemblies. An improved method of making binders, folder covers and the like from continuous stationery assemblies is also disclosed.

These continuous stationery assemblies comprise at least front and rear continuous webs. Each of the front and rear webs has at least one line of marginal feed apertures, lines of transverse perforations, a line of adhesive parallel and adjacent to one of the lines of marginal feed apertures, and a line of weakening so as to enable one of the webs to be folded over the other web to form a binder, folder cover and the like. Additional webs may be included in the assemblies and arranged so as to constitute additional binder sheets.

8 Claims, 14 Drawing Figures

CONTINUOUS STATIONERY ASSEMBLY AND METHODS OF MAKING BINDERS, FOLDER COVERS AND THE LIKE FROM THE ASSEMBLY

BACKGROUND AND SUMMARY OF THE INVENTION

The present invention relates to a continuous stationary assembly and a method of making binders, folder covers and the like. More particularly, the present invention relates to improved continuous stationary assemblies which can be readily converted into binders, folder covers, and the like and to an improved method of making binders, folder covers and the like from such continuous stationary assemblies.

Binders have long been used to bind sheets of printed information, and many different constructions of binders have been proposed. Generally such binders have consisted of a front cover sheet, a rear cover sheet, and a flap part disposed between the cover sheets to which sheets to be contained within the binder may be affixed. In the past, such binders have, to a large extent, been produced by manual production methods.

In the past, it has sometimes been required that a binder have personalized printed matter applied to one or both of its cover sheets. Such personalized printed matter was generally applied by individually typing the cover sheet of each binder in a typewriter (assuming the binder could be disposed around the typewriter platen) or by the application of a pre-printed tape or the like to the cover sheet of the binder. In either event, the application of personalized printed matter to such binders was difficult and time consuming, particularly where it was desired to make a relatively large number of binders.

It is a principal object of the present invention to provide an improved continuous stationary assembly which may be readily passed through a print unit and which may be subsequently processed, in a simple and convenient manner, to provide a binder capable of receiving record sheets and the like. A related object of the present invention is to provide an improved stationary assembly adapted for processing to produce a personalized binder. Another object of the present invention is to provide an improved method of making binders from continuous stationary assemblies, which include at least two webs, by detaching the original, side marginal feed perforations from the webs, separating the webs longitudinally into binder lengths, and then folding one of the webs over the other web whereby the one web constitutes the front cover sheet of the binder.

According to one aspect of the present invention, my improved continuous stationary assembly is capable of being passed, in a continuous form, through a print unit to have information applied to it and comprises at least front and rear continuous paper webs. Each web has: a line of marginal feed apertures in the side marginal portions of the webs, a line of tear off perforations within the line of marginal feed apertures; a line of adhesive to secure the two webs together, with the line of adhesive being disposed between the webs and parallel to and within the lines of feed apertures and tear off perforations; and a line of weakening, with the line of weakening being parallel to the line of feed apertures, being disposed within and adjacent to the lines of adhesive and being so arranged that the webs may be folded relatively to one another, one over the other, about the lines of weakening, to form a binder. According to another aspect of the present invention, an improved method of making a binder from the above described continuous stationary assembly comprises the steps of detaching the side marginal portions, containing the marginal feed apertures, from the webs, separating the webs into binder lengths, and folding the front webs relatively to one another, about the lines of weakening, the web bearing the line of weakening, one over the other, so as to form a binder folder and so that in the binder, the rear web is the front cover of the binder and the front web is the rear cover of the binder.

The preferred embodiments of the improved continuous stationary assembly and the improved method of making binders, folder covers and the like in accordance with the invention, will now be described with reference to the accompanying drawings wherein:

FIG. *7a* is a diagramatic, sectional view of another modified embodiment of a continuous stationary assembly of the present invention;

FIG. *7b* is a diagramatic, sectional view of a binder made from the assembly shown in FIG. *7a;*

Figure 8:
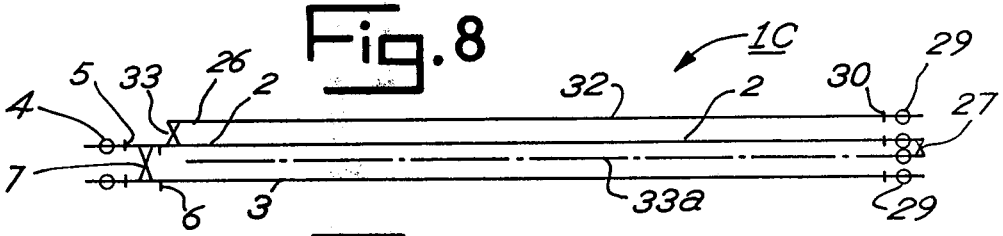
Figure 9:
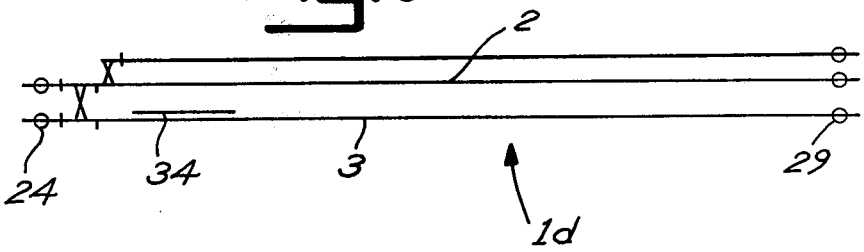
Figure 10A:
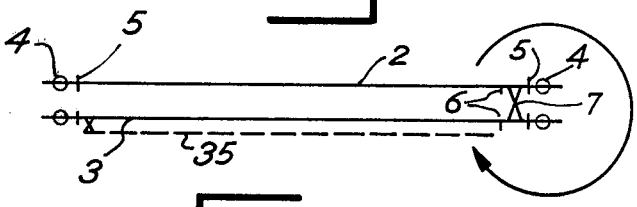
Figure 10B:
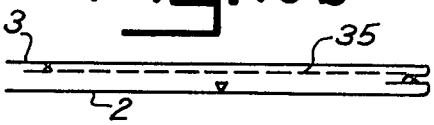

FIGS. 8 and 9 are diagramatic, sectional views of still other embodiments of continuous stationary assemblies of the present invention;

FIG. 10*a* is a diagramatic, sectional view of a further embodiment of a continuous stationary assembly of the present invention;

FIG. 10*b* is a diagramatic, sectional view of a binder made from the assembly shown in FIG. 10*a;*

Figure 11A:
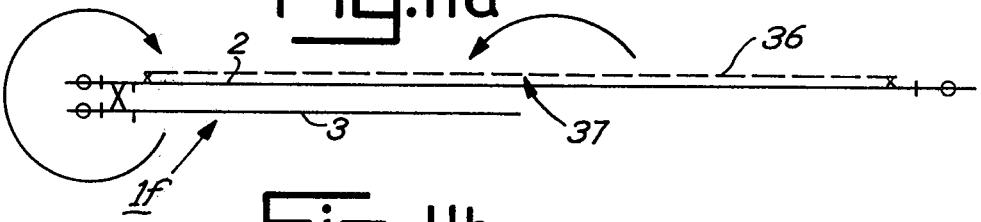
Figure 11B:
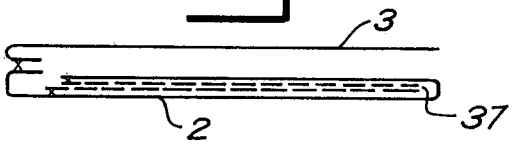

FIG. 11*a* is a diagramatic, sectional view of a still further embodiment of a continuous stationary assembly of the present invention; and FIG. 11*b* is a diagramatic, sectional view of a binder made from the assembly shown in FIG. 11*a.*

DESCRIPTION OF THE PREFERRED EMBODIMENTS

Figure 1:
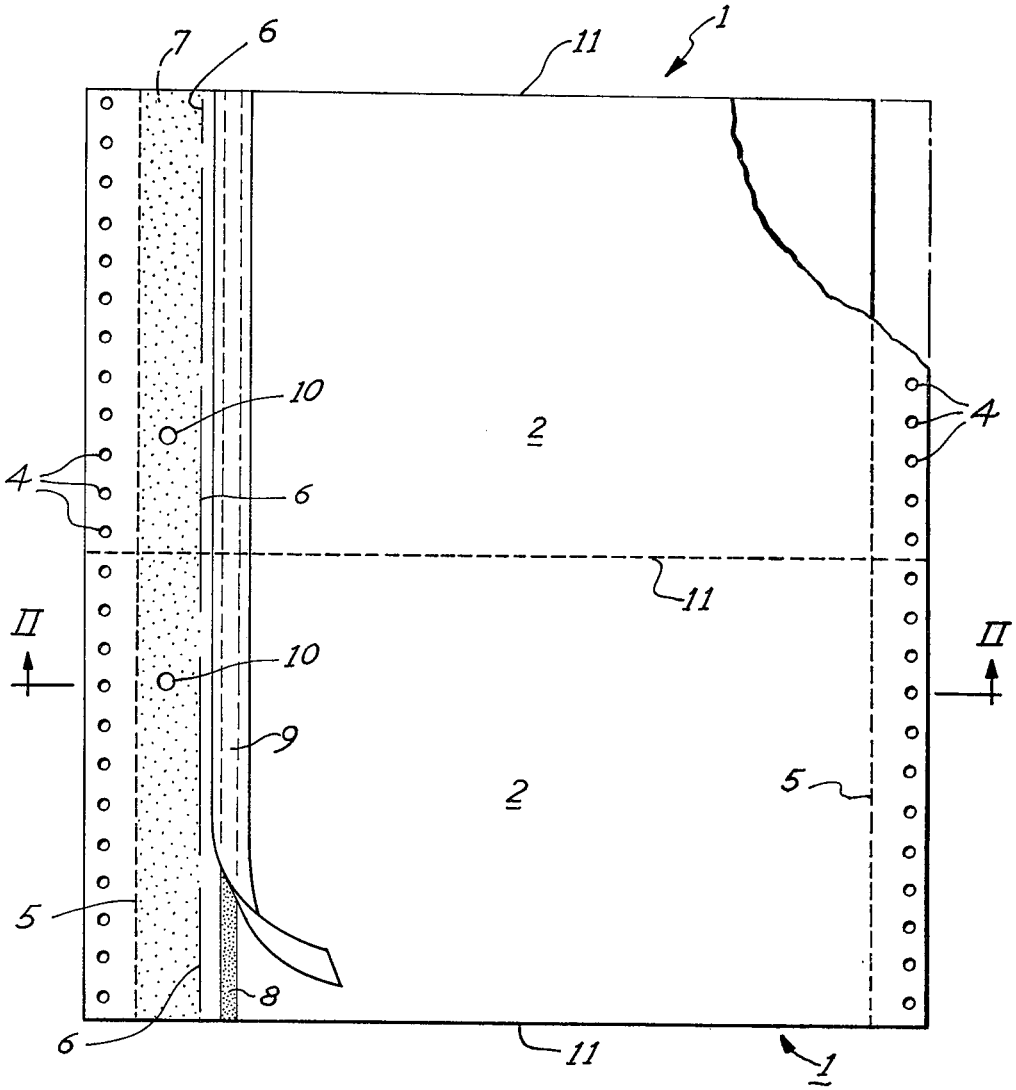
FIG. 1 is a plan view of a continuous stationary assembly of the present invention.
Figure 2:
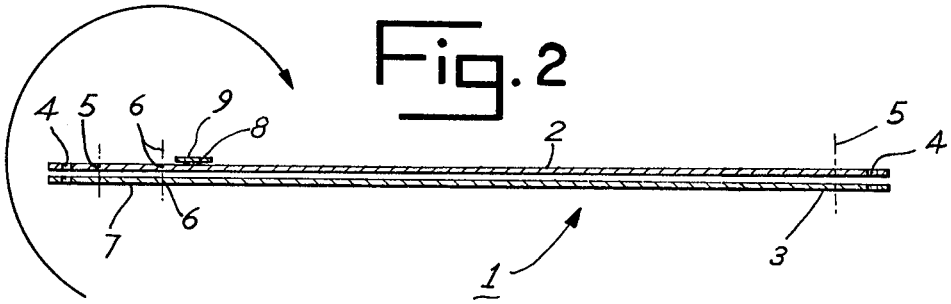
FIG. 2 is a sectional view taken on the line II—II of FIG. 1.

Referring to FIGS. 1 and 2 of the drawings, there is shown a continuous stationary assembly 1 which is adapted to be converted into a binder, folder cover or the like and which includes a front or upper web 2 and a rear or lower web 3. Static data may be printed on the webs 2 and 3, as required, before the webs are assembled, and this may be, for example, in the form of a name and address of a company issuing the binder. Each of the webs 2 and 3 have a line of conventional marginal feed apertures 4 along their side marginal portions to enable the stationary assembly 1 to be fed through a print unit of a computer printout or other forms handling equipment so as to be able to have personalized or variable data applied to the webs. Such personalized or variable data may include the name and address of the person to whom the binder is to be addressed and may be typed or printed on the faces of the rear web 3 on each folder length of the assembly.

A line of tear off perforations 5 is arranged parallel and adjacent to and within each of the lines of feed apertures 4 on both of the webs 2 and 3. These lines of tear off perforations 5 enable the side marginal portions, containing the marginal feed perforations 4, to be readily detached from the remainder of the webs.

Lines of weakening 6 are provided in the front and rear webs 2 and 3 parallel to and inwardly of the lines of tear off perforations 5 of the left hand side of the webs, as shown in FIG. 1. The distance between the line 5 and the line 6 in each web is determined by the required or desired width of the flap needed to receive sheets to be retained in the binder to be herein described. A strip of adhesive 7 is provided between the webs 2 and 3. This strip extends longitudinally of the webs but only in the portion of the webs limited or defined by and between the lines 5 and 6.

A further strip of adhesive 8 is provided, within and parallel to the line of weakening 6, on the front face of the front web 2. This strip of adhesive is covered by a removal barrier strip 9 of the kind that may be readily peeled off to reveal or expose the strip of adhesive 8.

Apertures 10, which may be used as filing apertures, are provided in both webs 2 and 3 in the portion of the webs between the lines 5 and 6. Transverse lines of tear off perforations 11 are provided in the webs 2 and 3 to enable the continuous webs to be easily divided into binder lengths.

When the continuous stationary assembly 1, as shown in FIGS. 1 and 2, is to be made into a binder, the side marginal portions, containing the marginal feed perforations 4, are detached by separation along the lines of tear off perforations 5. This may be done manually or by passing the assembly 1 between slitters in a conventional slitting machine. The webs are longitudinally divided into binder lengths by tearing across the transverse line of tear off perforations 11.

Figure 3:
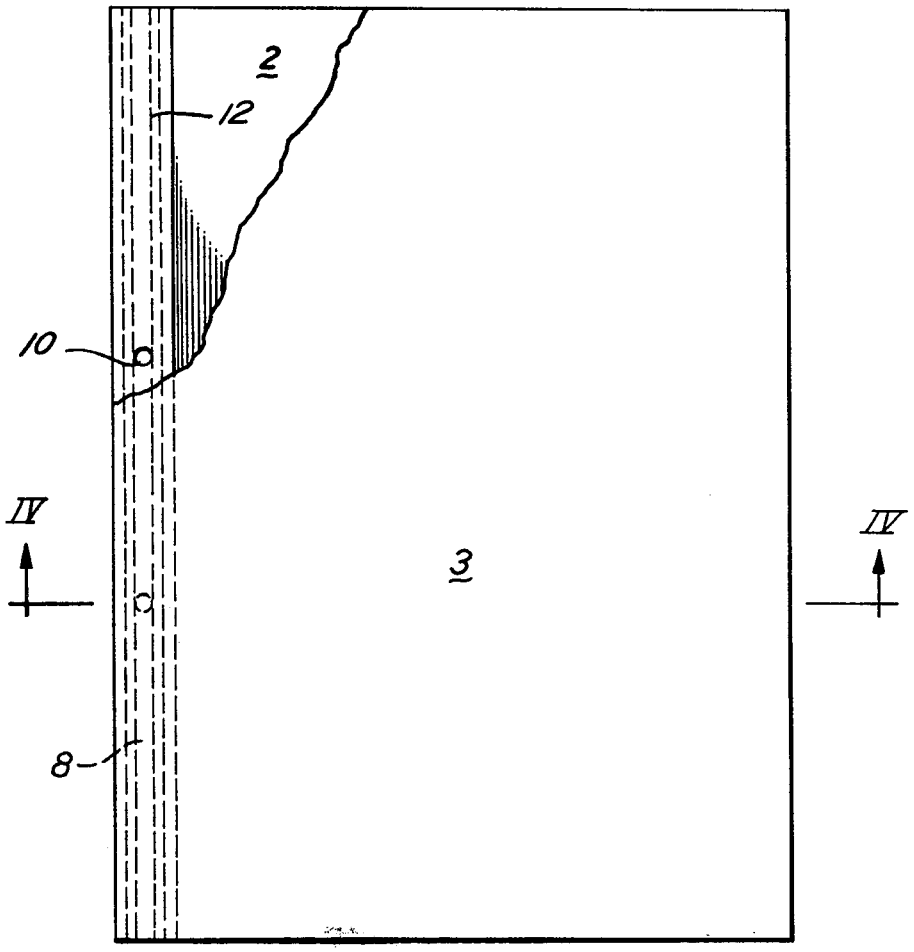
FIG. 3 is a plan view of a binder made from the continuous stationary assembly shown in FIGS. 1 and 2.
Figure 4:
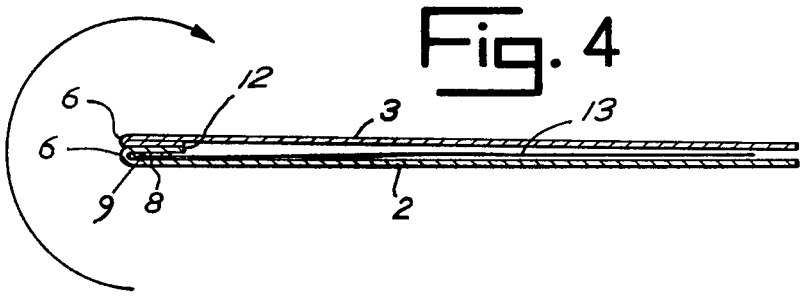
FIG. 4 is a sectional view taken on the line IV—IV of FIG. 3.

The rear web 3 (really now a sheet after the division of the assembly into binder lengths) of the binder length is then folded relative to and over the front web 2 (also now a sheet), in the direction of the arrow shown in FIG. 2, about the lines of weakening 6. More specifically, the web 2 and the web portion between the lines 5 and 6 are pivoted about the line of weakening 6 in the front web 2 and the rear web 3 is pivoted about the line of weakening 6 in the rear web 3 so that the webs assume the form shown in FIGS. 3 and 4, i.e. where the rear web 3 becomes the front cover sheet of the binder, where the front web 2 becomes the bottom cover sheet of the binder, and where the web portion between the lines 5 and 6 is disposed between the cover sheets and becomes a folder flap 12 adapted to receive folder record or insert sheets 13 as shown in FIG. 4.

Figure 5:
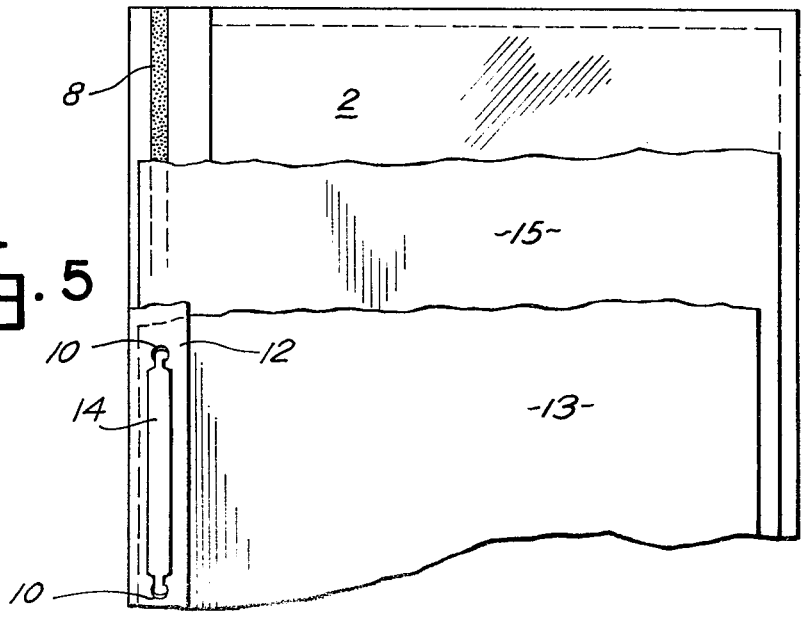
FIG. 5 is a partial plan view, similar to that of FIG. 3, showing additional insert sheets being secured in the binder made from the assembly shown in FIGS. 1 and 2.

The record sheets 13 may be secured by the strip of adhesive 8 which when the assembly 1 has been converted into a binder, is positioned on the upward facing face of the rear cover sheet of the binder. These sheets 13 may also be secured to the flap 12 by a conventional binder post 14 or the like, as shown in FIG. 5, instead of by the strip of adhesive 8. Even when a binder post 14 is utilized, additional record sheets can be secured to the rear cover sheet by removing the barrier strip 9 and applying the selected additional record sheets 15 to the exposed strip of adhesive 8.

Figure 6:
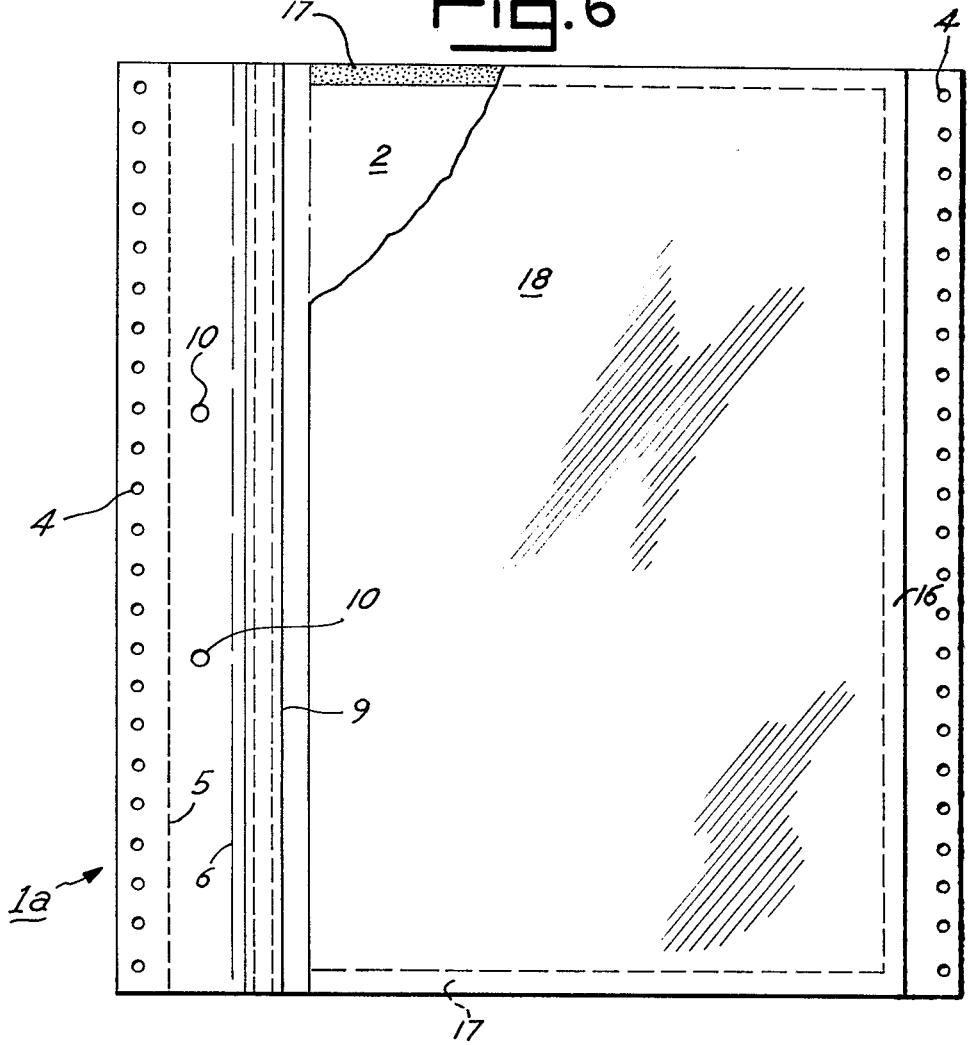
FIG. 6 is a plan view of a modified embodiment of a continuous stationary assembly of the present invention.

Referring to the embodiment shown in FIG. 6, a single binder length of an improved stationary assembly 1*a*, similar to the assembly 1 shown in FIGS. 1 and 2, includes a front web 2 and a rear web, not shown, disposed beneath the front web 2. However in this embodiment, a longitudinal strip of adhesive 16 is provided on the front face of the front web 2, inside the tear off line 5 and inside the marginal feed apertures 4, on the right hand side of the web as shown in FIG. 6. Transverse strips of adhesive 17 are also provided just on the front face of the front web 2. A further web 18, of transparent plastics material or of transparent cellulose material, is secured to the web 2 by these strips of adhesive 16 and 17 and is arranged, when the webs 2 and 3 are longitudinally divided into binder lengths, to form a pocket on the front web 2, and subsequently on the inside face of the rear cover sheet of a binder made from this modified assembly 1*a*. This pocket is adapted to receive sample sheets, and since the web 18 is transparent, such sample sheets can be viewed without the necessity for withdrawing them from the pocket.

Figure 7A:
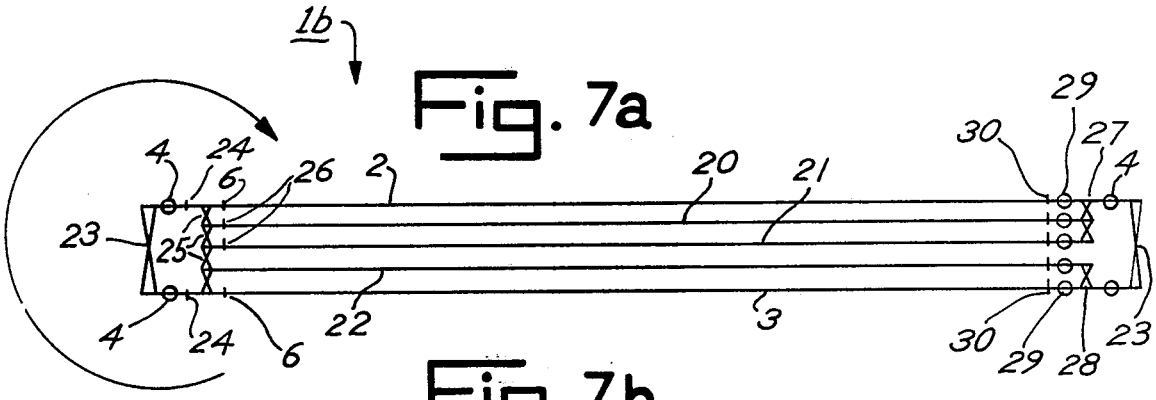

Referring to the embodiment of the present invention shown in FIG. 7*a*, an improved continuous stationery assembly 1*b* is similar to the assembly 1 shown in FIG. 2 and includes a front web 2 and a rear web 3 which constitutes the cover sheet of the binder to be made. Additional intermediate or copy webs 20 and 21 are included in this assembly 1*b* to provide detachable copy parts, and a further intermediate web 22 is provided to be retained in the binder. Each of the outer webs 2 and 3: are wider than the webs 20, 21 and 22 so that their side marginal portions extend transversely beyond the side marginal portions of the intermediate webs 20, 21 and 22; have marginal feed apertures 4 in their side marginal portions which are disposed beyond the side edges of the webs 20, 21 and 22; and have a line of adhesive 23 at and along each of their side marginal portions outside of or beyond the respective lines of feed apertures 4. On the left hand side of the outer webs 2 and 3, as shown in FIG. 7*a*, longitudinal lines of tear off perforations 24 are provided. Lines of adhesive 25, extending longitudinally of the webs 20, 21 and 22, are provided to secure the respective intermediate or copy webs 20, 21 and 22 to the respective webs 2 and 3 above and below them. Longitudinal lines of perforations 26 are provided just within the lines of adhesive 25 in the webs 20 and 21 but not in the web 22.

As shown on the right hand side of FIG. 7*a*, lines of adhesive 27 are provided to join the webs 20 and 21 to the outer web 2, and a longitudinal line of adhesive 28 is provided to join the web 22 to the outer web 3. A line of longitudinal feed apertures 29, and a longitudinal line of perforations 30 are provided in each of the webs 2, 20, 21, 22 and 3 inwardly of the lines 27, 28 and 4 and along the right hand side of the webs as shown in FIG. 7*a*.

Figure 7B:
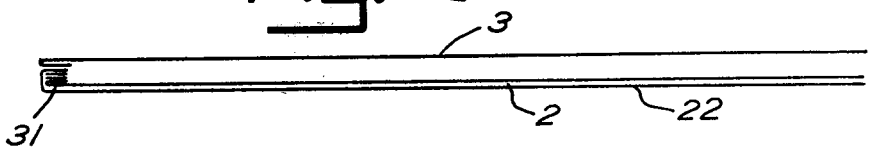

The assembly 1*b*, as shown in FIG. 7*a*, may be preprinted and may have additional personalized data applied to it, as for example, in a conventional print unit. After passage of the assembly 1*b* through such a print unit, the assembly is passed through a detacher unit whereupon the side marginal portions of the webs are detached by breaking the lines of perforations 24 and 30. The copy sheets 20 and 21 of the assembly are then removed, as by a snap out operation, and the webs are divided longitudinally into assembly lengths. The lower web 3 (now a sheet) is then folded over, in the direction of the arrow shown in FIG. 7*a*, about the lines of weakening 6 to form a binder such as shown in FIG. 7*b*. A stub 31 is formed when this folding over operation is effected and becomes a flap to which additional binder sheets may be secured as may be required.

Referring to FIG. 8 of the drawings, there is shown a further embodiment 1*c* of the improved continuous stationary assembly of the present invention which is similar to the assembly 1 shown in FIG. 2, but which does not have the line of adhesive 8 and the carrier strip 9. Rather, the assembly 1*c* has an additional copy sheet 32 of self-copy paper, i.e. paper with a coated back, secured to the front web 2 by a longitudinal line of adhesive 33. In addition, a web of carbon paper 33*a*, i.e. a conventional, one time carbon paper, is secured to the underside of the front web 2 at the right hand side thereof, as shown in FIG. 8.

Referring to FIG. 9 of the drawings, there is shown still another embodiment 1*d* of the present invention which is similar to the assembly 1 shown in FIG. 2 but which does not have an adhesive 8 or the carrier strip 9. Rather a self-copy sheet, i.e. paper with a coated front, or label 34 is applied to the rear sheet 3 by adhesive.

Referring to FIG. 10*a*, there is shown a personalized assembly 1*e* that is somewhat similar to the assembly 1*a* shown in FIG. 2, except that a plastic cover sheet 35, which is adapted to contain samples or brochures, is applied to the rear or underside of the rear web 3 by means of lines of adhesives 16 and 17, and except that the webs 2 and 3 are adapted to be folded about the lines of weakening 6 in the right hand side of the webs. The sheet 35 is arranged at the underside of rear web 3 to prevent the difficulties in printing through the more rigid plastic sheet 35 i.e. in reproducing the data printed on the web 2 to the underlying sheets, if the sheet 35 was on the front web 2. As shown, the front web 2 is folded over, in the direction of the arrow (the reverse of the direction of the arrow in FIG. 2) to form the binder shown in FIG. 10*b*.

FIG. 11*a* shows a still further embodiment 1*f* of the present invention which is similar to the assembly 1*a* shown in FIG. 6 but wherein the widths of the front web 2 and a top plastic cover sheet 36 are extended beyond that of the rear web 3 and are formed with additional lines of weakening 37. The front web 2 and sheet 36 are folded about the lines 37 before the rear sheet 3 is folded over them. A binder made from assembly 1*f* is shown in FIG. 11*b*.

In still another modification of the present invention, which is similar to the modification shown in FIG. 6, the transverse strips of adhesive 17 may be omitted so that transverse flaps are provided, rather than a pocket as in the FIG. 6 embodiment. Samples of sheets of paper may then be retained beneath the flaps.

Thus, since the invention disclosed herein may be embodied in other specific forms without departing from the spirit or central characteristics thereof, the preferred embodiments described herein are therefore to be considered in all respects as illustrative and not restrictive, the scope of the invention being indicated by the appended claims, rather than by the foregoing descriptions, and all changes which come within the meaning and range of equivalency of the claims are therefore intended to be embraced therein.

I claim:

1. An improved, continuous stationary assembly having an assembly length in a longitudinal direction and an assembly width in a transverse direction perpendicular to said longitudinal direction adapted to be passed longitudinally, in continuous form, through a print unit to have information applied thereto and also adapted to be readily made into a binder, folder cover and the like comprising:

at least two continuous webs, superimposed one on top of the other, so that one web is a front web and the other web is a rear web;

each of the webs having: two longitudinally extending side edges and a web width in the transverse direction defined between the two side edges, the web width of one of said webs matching said assembly width, two longitudinally extending side marginal portions each defined adjacent a side edge and extending longitudinally therealong, a longitudinally extending line of marginal feed apertures in one side marginal portion, a longitudinally extending line of tear off perforations adjacent said one side marginal portion and extending therealong disposed nearer the other side marginal portion than the line of marginal feed apertures;

said front web and said rear web superimposed one on top of the other with the line of marginal feed apertures of the front web superimposed on top of the line of marginal feed apertures of the rear web and the line of tear off perforations of the front web superimposed on top of the line of tear of perforations of the rear web;

a longitudinal extending line of adhesive being applied to and between the front and rear webs to secure the front and rear webs together, with the line of adhesive being disposed adjacent to the lines of tear off perforations and nearer the other side marginal portions than the lines of tear off perforations; and a longitudinally extending line of weakening in each of the front and rear webs, with the lines of weakening being disposed adjacent to the line of adhesive, nearer the other side marginal portions than the line of adhesive and being superimposed one on top of the other such that the rear web is foldable about and relative to the lines of weakening over the front web so as to form a binder, folder cover and the like and such that a longitudinal marginal portion of the webs, which is defined as the portions of the webs between the lines of weakening and the lines of tear off perforations and which contains the line of adhesive, constitutes a flap extending between the webs for supporting an insert sheet when the rear web is folded about the front web so as to form a binder, folder cover and the like.

2. The improved continuous stationary assembly according to claim 1 wherein the longitudinal marginal portion includes means for securing insert sheets to the supporting flap.

3. The improved continuous stationary assembly according to claim 1 wherein each of the webs further have transversely extending, longitudinally spaced lines of tear off perforations such that the webs are adapted to be easily divided in the longitudinal direction into binder lengths defined between said transversely extending, longitudinally spaced lines of tear off perforations.

4. The improved continuous stationery assembly according to claim 1 wherein one of the continuous webs has an additional web secured to it by longitudinal and transverse lines of adhesive so as to form a pocket between the additional and the one webs in each binder length of the assembly.

5. A continuous stationery assembly according to claim 1 wherein one of the webs bears, in each binder length, data of a personalized nature.

6. A continuous stationery assembly according to claim 1 further comprising:

additional webs disposed between the front and rear webs having additional longitudinally extending lines of tear off perforations adjacent said line of adhesive and nearer the other side marginal portions of the front and rear webs than the line of adhesive such that said additional webs are detachable by perforation to provide detachable copy parts, and additional longitudinally extending lines of adhesive between the additional webs and the front and rear webs nearer the line of adhesive than the additional lines of tear off perforations.

7. An improved method of making a binder, folder cover and the like comprising the steps of:

forming an improved, continuous stationary assembly having an assembly length in a longitudinal direction and an assembly width in a transverse direction perpendicular to said longitudinal direction and further having two continuous webs superimposed one on top of the other, so that one web is a front web and the other web is a rear web, each web having two longitudinally extending side edges and a web width in a transverse direction defined between the two side edges, the web width of one of said webs matching said assembly width, two longitudinally extending side marginal portions each defined adjacent a side edge and extending longitudinally therealong, a longitudinally extending line of marginal feed apertures in one side marginal portion, a longitudinally extending line of tear off perforations adjacent said one side marginal portion and extending therealong disposed nearer the other side marginal portion than the line of marginal feed apertures, said front web and said back web being superimposed one on top of the other with said lines of marginal feed apertures superimposed one on top of the other and said lines of tear off perforations superimposed one on top of the other;

applying a longitudinally extending line of adhesive to and between the front and rear webs to secure the front and rear webs together, with the line of adhesive being disposed adjacent to the lines of tear off perforations;

weakening each of the webs along a longitudinally extending line of weakening in each of the front and rear webs, with the lines of weakening being disposed parallel to and nearer the other side marginal portion than the line of adhesive and being superimposed one on top of the other such that the rear web is foldable about and relative to the lines of weakening over the front web so as to form a binder, folder cover and the like and such that a longitudinal marginal portion of the webs, which is defined as the portions of the webs between the lines of weakening and the lines of tear off perforations and which contains the line of adhesive, constitutes a flap extending between the front and rear webs for supporting an insert sheet when the rear web is folded about the front web so as to form a binder, folder cover and the like;

perforating each of the webs along longitudinally spaced, transversely extending lines of tear off perforations so that the webs are adapted to be easily divided in the longitudinal direction into binder lengths;

detaching the side marginal portions along the lines of tear off perforations;

separating the webs in the continuous stationary assembly into binder lengths; and folding the rear web over the front web so as to form a binder, folder cover and the like.

8. The improved method according to claim 6 including the step of applying personalized data to at least one of the webs in the continuous stationery assembly in a print unit.

* * * * *